US006513723B1

(12) United States Patent
Mueller et al.

(10) Patent No.: US 6,513,723 B1
(45) Date of Patent: Feb. 4, 2003

(54) METHOD AND APPARATUS FOR AUTOMATICALLY TRANSMITTING TEMPERATURE INFORMATION TO A THERMOSTAT

(75) Inventors: Carl J. Mueller, St. Louis, MO (US); Bartholomew L. Toth, St. Louis, MO (US); Frank A. Albanello, St. Louis, MO (US)

(73) Assignee: Emerson Electric Co., St. Louis, MO (US)

( * ) Notice: Subject to any disclaimer, the term of this patent is extended or adjusted under 35 U.S.C. 154(b) by 0 days.

(21) Appl. No.: 09/672,553

(22) Filed: Sep. 28, 2000

(51) Int. Cl.[7] ..... F23N 5/20; G08B 17/00

(52) U.S. Cl. ..... 236/46 R; 236/51; 340/584; 374/167

(58) Field of Search ..... 236/46 R, 5; 340/584, 340/870.17, 589; 374/167

(56) References Cited

U.S. PATENT DOCUMENTS

| | | | | |
|---|---|---|---|---|
| 4,132,355 | A | 1/1979 | Cleary et al. | 236/47 |
| 4,391,913 | A | 7/1983 | Keldmann | |
| 4,433,719 | A | 2/1984 | Cherry et al. | |
| 4,734,871 | A | 3/1988 | Tsunoda et al. | |
| 4,776,179 | A | 10/1988 | Ta | |
| 4,860,950 | A | 8/1989 | Reeser et al. | |
| 5,135,045 | A | 8/1992 | Moon | |
| 5,224,353 | A | 7/1993 | Nagasawa | |
| 5,224,648 | A | 7/1993 | Simon et al. | |
| 5,390,206 | A | 2/1995 | Rein et al. | |
| 5,595,342 | A | 1/1997 | McNair et al. | |
| 5,711,480 | A | 1/1998 | Zepke et al. | |
| 5,743,465 | A | 4/1998 | Jeong | |
| 5,927,599 | A | 7/1999 | Kath | |
| 6,213,404 | B1 * | 4/2001 | Dushane et al. | 236/51 |
| 6,260,765 | B1 * | 7/2001 | Natale et al. | 236/47 |

* cited by examiner

*Primary Examiner*—William Wayner
(74) *Attorney, Agent, or Firm*—Harness, Dickey & Pierce, P.L.C.

(57) ABSTRACT

A method and device includes the use of multiple remote sensors transmitting temperature information to a thermostat, while reducing or eliminating transmission interference and providing increased user control. Remote temperature sensors of the present invention sense temperature at variable time periods and only transmit temperature information on a sensed change in temperature. Transmission of temperature information is provided on variably selected frequencies within a specified range, and may be based in part on previous temperature transmissions. A learn mode is provided that allows for recognition of each sensor by a host-controlling thermostat, including determining the proper transmission power level for each sensor. Additionally, each sensor is programmable to provide a temperature offset and each sensor may be individually weighted according to specific requirements or needs.

47 Claims, 5 Drawing Sheets

METHOD AND APPARATUS FOR AUTOMATICALLY TRANSMITTING TEMPERATURE INFORMATION TO A THERMOSTAT

FIELD OF THE INVENTION

The present invention relates to the field of thermostats, and in particular to a method and apparatus providing automatic transmission of temperature information to a thermostat.

BACKGROUND OF THE INVENTION

Typical thermostats for home or light commercial use generally are provided with a local temperature sensor within the thermostat housing to measure air temperature and adjust the climate control system attached thereto according to specified thermostat settings. These systems are limited in their application and oftentimes the thermostat is located such that temperature measurements are taken in less desirable areas of a building (e.g., in a hallway and not in the family room).

Systems were then developed that allowed for measuring temperature or other climate conditions in multiple rooms or on multiple floors of a building. For example, some homes are provided with a separate thermostat on each floor of the house, each of which individually controls the climate settings for the respective floors of the house. In other applications, multiple external sensors hardwired to a thermostat may be provided to transmit temperature or climate information from different rooms or floors of a building for use by the thermostat in controlling climate conditions. However, as the number of sensors required for a particular application grows and/or the retrofitting required becomes more complex (e.g., multiple sensors on multiple floors controlled by a single thermostat), the cost for hardwiring the sensors is increasingly expensive and installation increasingly complex.

Sensors were then designed for transmitting temperature information from a remote location separate from the digital thermostat, without the need for any wires, for example by using radio frequency or infrared signals. Although this reduces the cost of installing the sensors, problems arose with accommodating transmissions and avoiding transmission interference and collisions from multiple sensor in the same house or building, each having its own transmitter. The use of sensors transmitting on multiple frequencies or at different time periods reduces transmission collisions. However, if an apartment complex has a wireless thermostat system encompassing four sensors for each apartment, with 50 apartments in the transmitting radius, then at a minimum, 200 unique frequencies must be selected to prevent one from interfering with the other. Although this reduces the problem of transmission collisions, the cost for providing these unique frequencies is high, as the sensors would have to provide for selecting the unique frequencies (e.g., a dip switch, keypad or display for selecting the frequencies). Further, transmitters capable of supplying these different frequencies would also have to be provided.

The known systems fail to provide efficient and adequate variable time sensing of temperature and random remote transmission of temperature information, while also providing user control of the sensor settings. Therefore, what is needed is a method and device for providing automatic remote temperature sensor transmission of temperature information, with transmission on variable frequencies only on a change in temperature. The method and device needs to provide efficient transmissions, while minimizing interference and allowing control of the remote temperature sensors.

SUMMARY OF THE INVENTION

The present invention provides for the use of multiple remote temperature sensors that minimize transmission interference, while improving individual control of the sensors by allowing programming of each sensor by a user according to the user's specific temperature requirements (e.g., a user desiring to cool a room in which there is a remote sensor simply adjusts the temperature at the remote sensor to transmit adjusted temperature information). The present invention provides a remote temperature sensor preferably having a liquid crystal display for indicating temperature and other control information. The sensor preferably uses a transmitter (e.g., radio frequency transmitter) to transmit temperature and associated information to a host-controlling thermostat only on a sensed change of temperature. The temperature is also sensed at variable time periods which may vary only minimally.

The sensor may be provided such that an offset can be made to the temperature at a remote sensor to raise or lower a sensed temperature transmitted, thereby effectively adjusting the temperature information transmitted in a particular room as desired or needed. Further, the invention may provide for weighting each temperature sensor, such that the temperature information transmitted from one sensor is given more weight in adjusting the climate control system than another sensor.

Succinctly, the invention provides both a method and device for use in connection with a thermostat for controlling a climate control system, which includes remote temperature sensors that may be programmable, and that transmit temperature information with minimized interference. Specifically, the invention is preferably provided such that a unique serial number and/or channel number information is transmitted along with the temperature information on a variably selected frequency (e.g., random frequency) within a fixed range. Further, sensing of air temperature may be provided at variable time intervals (e.g., a time offset provided based on a previous sensed temperature) and transmission of the sensed temperature transmitted only on a predetermined temperature change (i.e., comparing the current sensed temperature with a previously transmitted temperature and transmitting only upon a predetermined change). Thus, the possibility of transmission collisions is reduced or eliminated.

Additionally, the present invention may be provided with a learn mode such that the host-controlling thermostat may initially identify each sensor for later recognition of transmitted temperature information from each of the sensors. Each sensor may also be provided with a plurality of power transmission levels, giving the invention further adaptability and increased utility in retrofit applications.

While the principal advantages and features of the present invention have been explained above, a more complete understanding of the invention may be obtained by referring to the description of the preferred embodiments which follow.

DETAILED DESCRIPTION OF THE PREFERRED EMBODIMENTS

Figure 1:
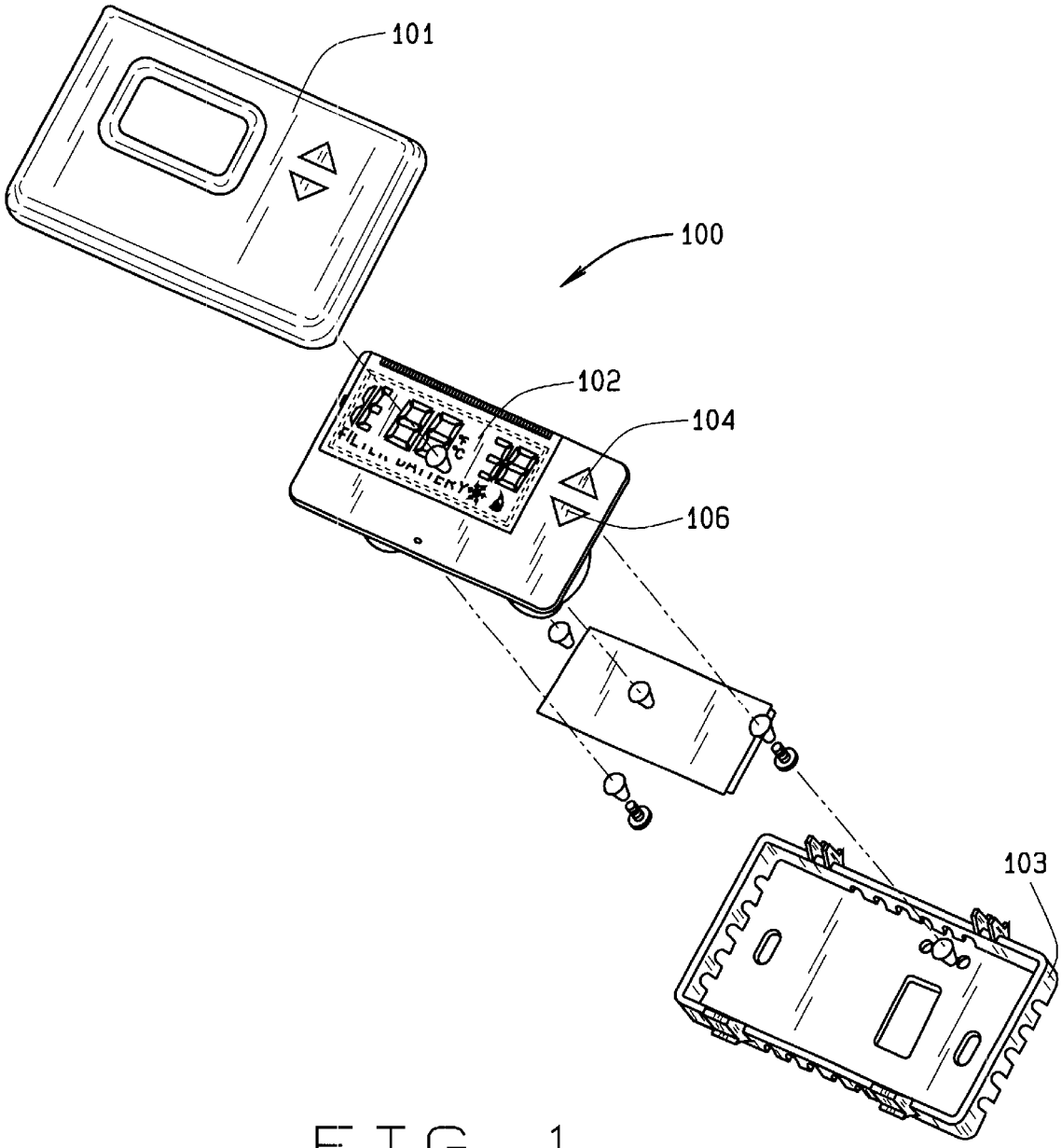
FIG. 1 is a perspective view of a remote sensor constructed according to the principles of the present invention.

A remote temperature sensor constructed according to the principles of the present invention is shown in FIG. 1 and indicated generally by reference numeral 100. In the most preferred embodiment, the temperature sensor 100 is provided with a liquid crystal display (LCD) 102, a temperature up button 104, a temperature down button 106 and a transmitter, together providing for control of the remote sensor 100 and transmission of temperature information to an associated host-controlling thermostat.

More specifically, the sensor 100 is preferably provided with a single integrated chip radio transmitter encased within a cover 101 and base 103, which transmits temperature and/or associated climate control information to a host-controlling thermostat. The particular transmitter provided may be determined according to the needs of the particular application, including the type of host-controlling thermostat and the receiver therein. The temperature up and temperature down buttons 104 and 106 provide for setting certain control parameters of the sensor 100, as well as adjusting the sensed temperature transmitted by providing a temperature offset depending upon the needs of a specific user (e.g., when a user determines that a specific room is hotter or colder than desired, the user may specify an offset, for example three degrees warmer, to the sensed temperature information transmitted, thereby resulting in the transmission of the sensed temperature along with a difference specified by the user offset). Thus, the sensor 100 preferably provides for remote transmission of temperature information with the ability to adjust sensed temperature locally at the sensor and allow for user programmable parameters.

Figure 2:
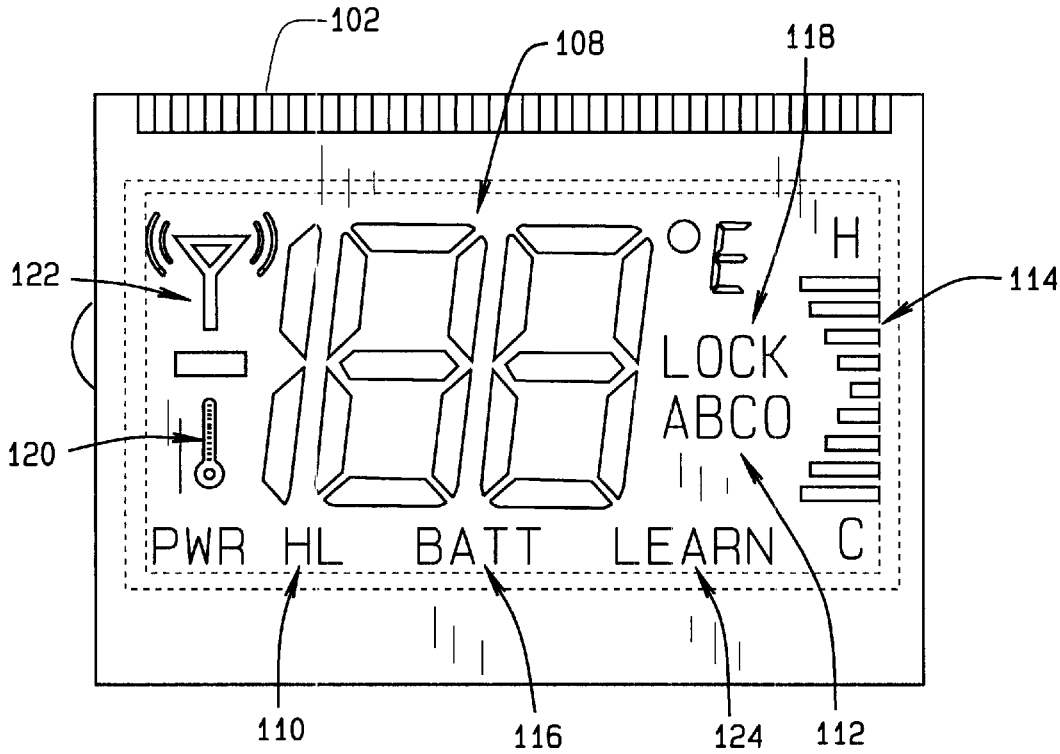
FIG. 2 is a front plan view of the LCD display of the remote sensor of FIG. 1.

The LCD display 102, as shown in FIG. 2, preferably provides for displaying temperature and control information, including: sensed temperature (either in Fahrenheit or Celsius) at 108, power level indicated as PWR H or L at 110, channel identification (A, B, C or O) at 112, a vertical comfort adjust bar graph at 114 indicating a user offset, a LOW battery indicator at 116, a LOCK out indicator at 118, a temperature sensing symbol at 120, a transmission time symbol at 122, and a LEARN mode activation indicator at 124. In the preferred normal operating mode, the LCD display 102 will provide information regarding sensed temperature at 108 (in either Fahrenheit or Celsius), the comfort adjust bar graph at 116, and channel identification information at 112. Alternately, depending upon the particular application, the LCD display 102 may be provided such that normally the display is blank (e.g., to prevent unauthorized adjustment of a sensor in a building).

The sensor 100 preferably includes two modes of operation, a learn mode and a normal operating mode. Additionally, a menu mode is provided that allows for adjustment of sensor settings and selection of sensor functions or features. The learn mode, which is enabled in the menu mode as described herein, provides for set-up of a specific sensor 100, including allowing the host-controlling thermostat to identify that specific sensor 100. Subsequent to the learn mode, the sensor 100 will revert to normal operating mode, wherein normal temperature transmission is provided. The sensor 100 operates in the normal mode unless the learn mode is again selected (e.g., if the channel identification for the sensor 100 needs to be changed).

With respect to the menu mode, it may be accessed or entered by depressing and holding the temperature up button 104 and temperature down button 106 for a predetermined period of time, for example, two seconds. The LCD display 102 will then be blank except for a first function or feature display. The temperature up key 104 is then preferably used (i.e., depressed) to scroll through the selectable functions or features. The following functions or features are preferably provided: channel identification (A, B, C or O), ° F./° C. selection, learn mode, power selection, key pad lockout, and display blank. Each of these features can be incremented, toggled, enabled, or disabled preferably using (i.e., depressing) the temperature down button 106. The menu is preferably exited by depressing the temperature up button 104, or after a certain elapsed time period, for example, 120 seconds. All parameters are preferably stored in a non-volatile memory, for example, an EEPROM.

It should be noted that when reference is made to using a button or operating a button, this means that a user simply manually operates the button by touching, pressing or depressing the button as required. Additionally, a button can refer to any touch operable element. Alternately, other selectable members, such as switches may be provided.

Learn Mode

The sensor 100 is preferably provided such that identification information may be automatically transmitted to the host-controlling thermostat during a learn mode. This one time learn mode is preferably enabled in the menu mode as disclosed herein. With the learn mode enabled, the sensor 100 preferably transmits at predetermined intervals, for example, every 10 seconds, a signal identifying the sensor 100, until disabled in the menu mode or after a time period has elapsed, for example 5 minutes. The LCD display 102 preferably indicates LEARN on the display when this mode is enabled. Depending upon the type of host-controlling thermostat, a tri-colored LED may be provided on the thermostat to confirm when the host-controlling thermostat recognizes a specific sensor 100 signal. For example, the LED may be green when the signal from the specific sensor 100 is strong, and the LED may be red when the specific sensor 100 signal is not recognized.

With respect to identification of each specific sensor 100, a unique identification number is preferably preprogrammed into each sensor 100 for use in determining the sensor 100 from which temperature information is transmitted. This unique identification number is transmitted by the sensor 100 and identified by the host-controlling thermostat during the learn mode, thereby allowing the host-controlling thermostat to recognize the transmission of the specific sensor 100 during its normal operating mode. For example, during the learn mode, a sensor 100 preferably transmits a sixteen bit unique identification number, such as 0110111000110100, which is received by the host-controlling thermostat and stored within the memory of the thermostat (e.g., EEPROM). This unique identification number is subsequently transmitted each time with the sensed temperature information from the sensor 100 to the host-controlling thermostat to identify the transmitting sensor.

Figure 7:
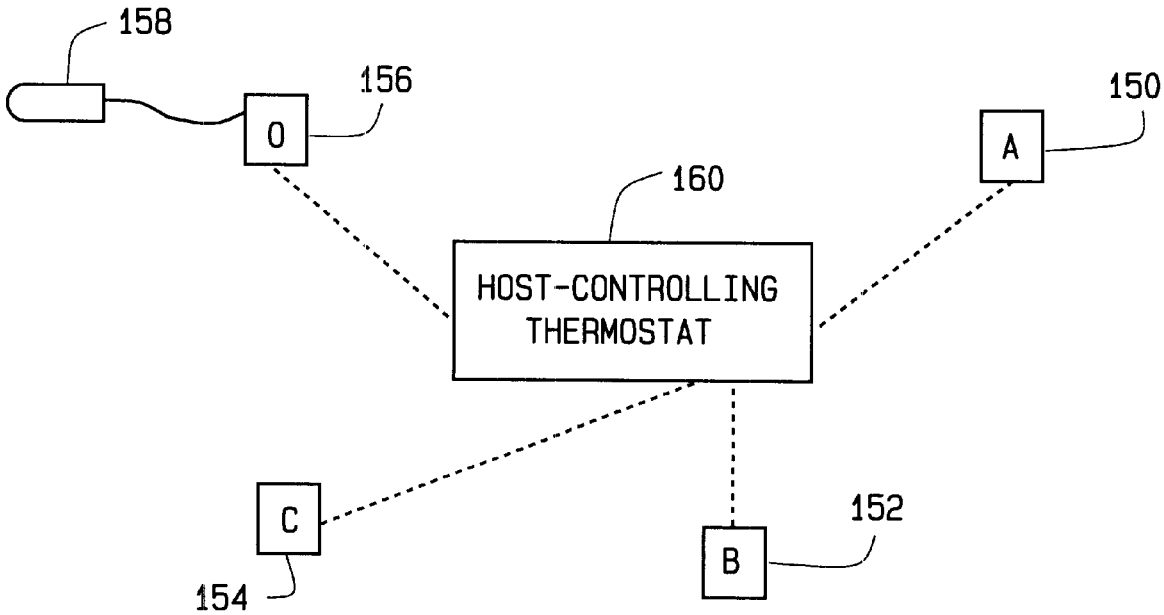
FIG. 7 is a schematic view of a thermostat and multiple sensors constructed according to the principles of the present invention.

Further, for each sensor 100, a transmission channel may be selected. Specifically, channel selection is provided in the menu mode of the sensor 100 and allows for selection of preferably either A, B, C or O (outdoor), which is displayed at 112 on the LCD display 102. Again, to enter the menu mode, a user depresses the temperature up and temperature down buttons 104 and 106 at the same time, and uses the temperature up button 104 to select this feature. The temperature down button 106 may then be used to increment the display from A to B to C to O and when selected, the menu mode may be exited by depressing the temperature up button 106. Thus, as shown in the preferred embodiment in FIG. 7, four separate temperature sensors, including sensor A 150, sensor B 152, sensor C 154 and sensor O 156, with probe 158, may be provided in connection with a single host-controlling thermostat 160. Each of the sensors transmits sensed temperature information to the host-controlling thermostat 160 as described herein and the temperature information may be displayed for each sensor on the host-controlling thermostat. For example, a user may select a specific sensor 100 as defined by its channel (e.g., sensor 150 identified as channel A and located in the living room) using the host-controlling thermostat, and view the most recent transmitted temperature by that sensor on the thermostat (which thermostat may be, for example, the Series 1F93/4/5 thermostat manufactured and sold by the White-Rodgers Division of Emerson Electric Co.). It should be appreciated by one skilled in the art that the invention is not limited to four channels, and additional channels may be provided as needed to accommodate additional sensors 100.

Selection of channel A, B or C provides for transmission of the temperature sensed in a building during normal operating mode. Selection of channel O allows for the connection of a weather-proof remote sensor probe to the sensor 100. The probe preferably provides temperature sensing using a thermistor. When selection of the O channel is made in the menu mode, the LCD display 102 will thereafter indicate the three digit outdoor temperature during normal operating mode. The sensed outdoor temperature is transmitted to the host-controlling thermostat, and may be displayed on the host-controlling thermostat, but the temperature information is not used by the host-controlling thermostat when controlling a climate control system (i.e., the sensed outdoor temperature is not processed by the host-controlling thermostat when determining whether to adjust the climate control system to which it is connected). When the outdoor channel selector (O) is enabled in the menu mode, transmission of temperature information is provided preferably upon a one degree Fahrenheit or more change. Additionally, the temperature is preferably sensed at a rate of ten minutes plus the four least significant bits of the temperature frequency output from the last reading, as described in more detail below. Additionally, when this channel is selected, the buttons are preferably locked out, which is indicated by LOCK at 118 on the LCD display 102 (i.e., a user cannot use the buttons to program a sensor 100), and the vertical comfort adjust bar graph displayed at 114 is locked.

During the learn mode, the proper setting of the power transmission level of the sensor 100 is preferably also determined. Specifically, sensor operation is preferably provided in either a high or lower power mode. For example, if the sensor 100 and the host-controlling thermostat are in close proximity to each other, overloading of the receiver within the thermostat may occur if the sensor 100 is operating in high power mode. However, if the sensor 100 and host-controlling thermostat are separated by a significant distance (e.g., on separate floors of a building), then the sensor is preferably operated in the high power mode to ensure proper transmission of temperature information. In the high power mode, transmission power is preferably limited such that other buildings (e.g., surrounding homes) do not receive the transmitted information, and therefore the transmission does not interfere with similar transmissions in the other buildings. Specifically, in order to select the transmission power level, a user operates the sensor 100 to enter the menu mode and select this function. Depressing the temperature down button 106 will toggle the function and display on the LCD display 102 either L for low power mode or H for high power mode. A user may then select the desired power mode for optimum signal transmission and battery life and exit the menu by depressing the temperature up button 104. Depending upon the specific host-controlling thermostat used in combination with the sensor 100, a tri-colored light emitting diode (LED) may be provided on the host-controlling thermostat to indicate whether transmission power from a particular sensor during the learn mode is sufficient. This may be provided by fast radio strength signal indicator (FRSS) circuitry in the receiver of the thermostat, which circuitry determines the signal strength of the temperature sensor 100 transmission. Thus, this allows the user to determine the best power mode of operation. For example, the LED of the thermostat may be green when transmission power is sufficient; the LED of the thermostat may be red when transmission power is insufficient, and therefore the sensor 100 must be switched from low power mode to high power mode; and the LED of the thermostat may be amber indicating that signal strength is marginal and the high power mode should preferably be selected. An example of the type of thermostat that may be used as the host-controlling thermostat for the sensor 100 is the Series 1F93/4/5 thermostat manufactured and sold by the White-Rodgers Division of Emerson Electric Co.

Additionally, the input from each sensor 100 can be weighted, such that the transmission of temperature information from different sensors is considered of different relative value when averaging the different sensed temperature readings to operate the climate control system. Preferably, each sensor may be designated as either average weight (AV), high weight (HI) or low weight (LO), with the HI weight being two times the weight of the AV weight, and the LO weight being one-half the AV weight. Thus, if two sensors transmit temperature information for use by the thermostat in climate control, with one sensor having an AV weight and the other having a HI weight, the actual temperature used for climate control is: two times the sensed temperature from the HI sensor plus the sensed temperature from the AV sensor, the total then divided by three. The setting of the weight of each sensor is preferably provided at the thermostat. However, it should be appreciated by one skilled in the art that the weighting of each sensor could be set at each sensor and transmitted as an extra bit with the temperature information.

Normal Operating Mode

During the normal operating mode of the sensor 100, temperature information is preferably transmitted to the host-controlling thermostat as described herein. Generally, during each transmission, the sensor 100 preferably transmits the following: the unique identification number of the sensor 100, the channel number selected for the sensor 100, temperature data, including sensed temperature with any user offset, and a low battery indication if the battery powering the specific sensor is low.

Figure 3:
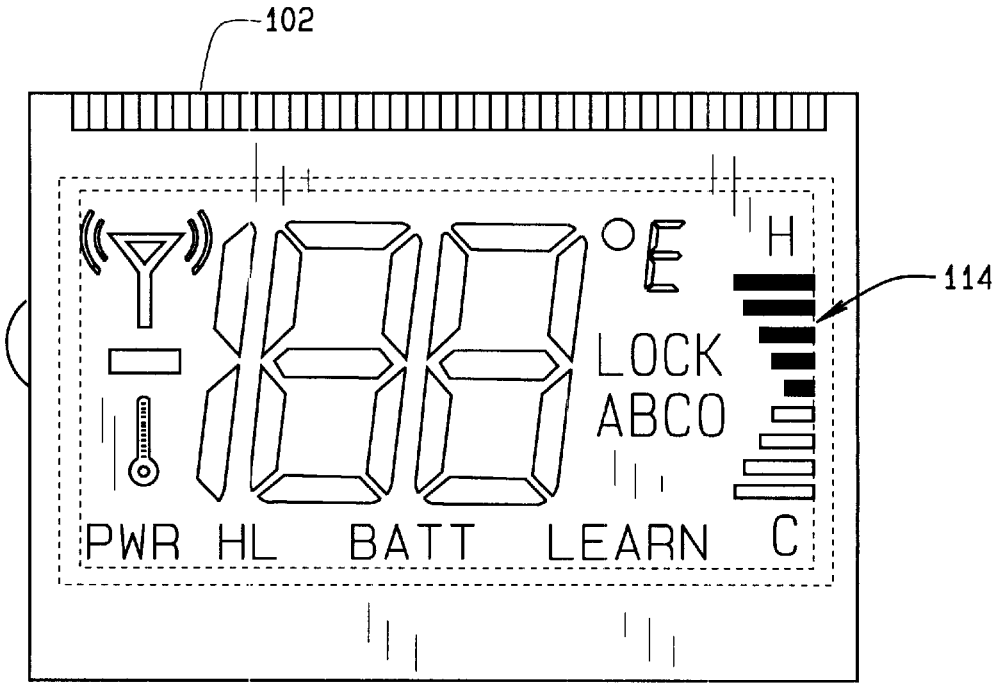
FIG. 3 is a front plan view of the LCD display of the remote sensor of FIG. 1 showing an increased temperature offset.
Figure 4:
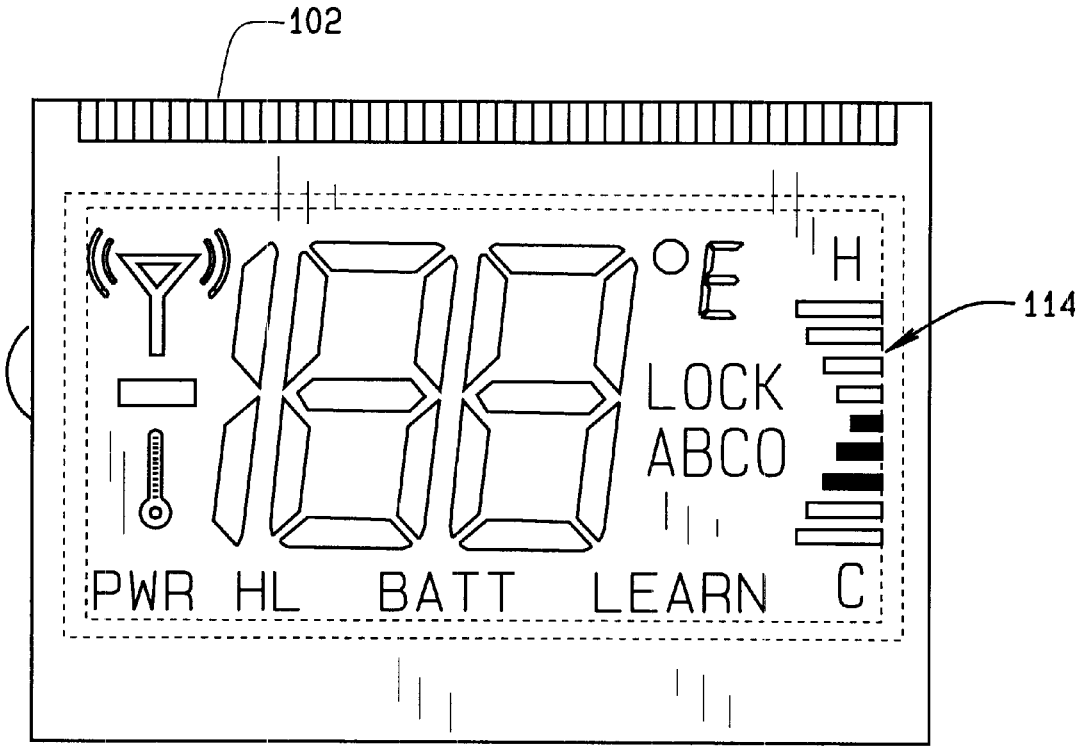
FIG. 4 is a front plan view of the LCD display of the remote sensor of FIG. 1 showing a decreased temperature offset.

The sensor 100 is preferably provided with user settable parameters for use during the normal operating mode. As shown in FIG. 2, the vertical comfort adjust bar graph displayed at 114 is preferably a vertical ten segment LCD with "H" and "C" icons indicating a settable offset temperature in degrees Fahrenheit or one-half degrees Celsius. The letter "H" indicates a hotter setting while the letter "C" a colder setting. The temperature offset information is preferably transmitted with the actual temperature as described herein. When the comfort adjust bar graph at 114 is in the middle of the display, preferably indicated by a darkened block, the actual sensed temperature is transmitted to the host-controlling thermostat upon a sensed temperature change, and no offset is provided. However, for example if a four degree increased Fahrenheit setting is selected (e.g., a user determines that a particular room in which a sensor 100 is located is too cool), such setting will be indicated on the comfort adjust bar graph at 114 as shown in FIG. 3, and a temperature offset will be transmitted with the actual temperature. The offset temperature data provided to the host-controlling thermostat is used in controlling operation of, for example, a climate control system. Further, as shown in FIG. 4, if a lower temperature offset is selected (e.g., a user determines that a particular room in which a sensor 100 is located is too warm), a temperature offset will again be provided in addition to the actual temperature transmitted. The comfort adjust bar graph displayed at 114 is preferably incremented with the temperature up button 104 and decremented with the temperature down button 106. Preferably, this offset is transmitted with the actual sensed temperature for a predetermined period of time (e.g., four hours). After the expiration of such predetermined period of time, the sensor 100 preferably resets the offset to zero.

Specifically, with respect to the temperature offset compensation provided from the temperature sensor 100 when such offset is activated, the receiver in the host-controlling thermostat preferably receives the offset number and an additional bit to indicate whether the offset was hotter (H) or colder (C). Based upon the number of active indoor remote sensors, the thermostat preferably multiplies the offset number with the number of active indoor remote sensors. This ensures that the offset value is not reduced when the thermostat is averaging the temperatures of all the sensors 100. Therefore, for example, if there are two active indoor remote sensors and the offset value transmitted is three degrees hotter (H), the receiver will multiply two times three, and six degrees will be subtracted from the actual temperature received because H was transmitted. If a colder (C) setting had been transmitted, then the six degrees would have been added to the actual temperature.

Additionally, a temperature calibration may be provided such that the sensor 100 transmits each time at a higher or lower temperature than is actually sensed, such that the thermostat receives and processes the offset sensed temperature as if it were the actual sensed temperature. This calibration is preferably selected and set within the menu mode. The user settable offset may then be additionally provided as described above.

The selection of temperature scale, which may be displayed in either degrees Fahrenheit or degrees Celsius, is set by entering the menu mode as described herein. Again, the temperature up key 104 will select the feature, and the temperature down key 106 will provide for toggling the display between degrees Fahrenheit and degrees Celsius. Preferably, when degrees Fahrenheit is selected, the vertical comfort adjust bar graph at 114 displays in one degree increments, while in degrees Celsius, the vertical comfort adjust bar graph at 114 displays in one-half degree increments. Again, the menu mode may be exited by depressing the temperature up key 104.

Preferably, a low battery (BATT) indication is also provided at 116 on the LCD display 102. This provides an alert when approximately 30 percent of battery life of the sensor 100 remains. During such low battery operation, all other display elements on the LCD display 102 are blank. Further, as described herein, during the transmission of sensed temperature during a low battery condition, an indication bit is preferably included of the low battery condition. If the temperature up button 104 or the temperature down button 106 is depressed during a low battery condition, the LCD display 102 will be activated for a specified period of time (e.g., 120 seconds) and provide the normal operating mode display.

Keypad lockout may also be provided and is selected by entering the menu mode. With keypad lockout enabled, a user will not be unable to operate or modify the parameters of the sensor 100 using the temperature up button 104 and temperature down button 106. The LCD display 102 preferably indicates LOCK on the display when this feature is selected, and this lockout may only be disabled by entering the menu mode again.

The sensor 100 is also preferably provided such that the LCD display 102 may be disabled, which is selected within the menu mode. When the LCD display 102 is disabled, the display is blank and the normal operating mode display may only be provided again by entering the menu mode. This provides a certain amount of security to prevent unwanted re-setting of the sensors 100.

Installation and Transmission

Typical installation of the sensor 100 includes powering the sensor 100 (e.g., providing battery power to the sensor) and selecting the learn mode of the sensor from the menu mode as disclosed herein. When in the learn mode, the temperature up button 104 is pressed once for every minute the learn mode transmit time is preferably activated. Thereafter, packet information is retransmitted every ten seconds until the expiration of the learn mode transmit time, up to ten minutes. During the period of time in which the remote sensor 100 is in the learn mode, the receiver in the host-controlling thermostat, which thermostat may be for example, the Series 1F93/4/5 thermostat, manufactured and sold by White-Rodgers Division of Emerson Electric Co., preferably is also placed in a learn mode to continuously scan all allowed frequencies looking for a leader transmission and learn bit, which identifies the unique numbered remote temperature sensor 100 that is transmitting packet information, which may include the sensor type, identification number, channel number, and other data identifying the sensor 100. This information is preferably stored within a memory of the host-controlling thermostat for later recognition of transmission from the sensor 100.

Additionally, during the learn mode, the thermostat may also display the signal strength and a determination can be made as to whether the sensor transmitter should be placed in high or low power transmission mode. Upon completion of the learn mode, the transmitter within the remote sensor 100 will begin normal operation of transmitting sensed temperature data to the host-controlling thermostat. The temperature is preferably sensed or measured at a variable time intervals as described in more detail below. This further provides randomization of the data transmission and minimization of transmission collisions. Additionally, as described herein, such transmission shall only occur if the new sensed temperature is different by pre-defined amount from a previous transmitted temperature (e.g., 2/16° F.). Additionally, as described herein, if the temperature does not vary by the pre-defined amount within a predetermined period (e.g., 30 minutes), then a transmission shall occur automatically to provide confirmation to the host-controlling thermostat that the sensor is still functioning properly. Preferably, this transmission is at the high power level to assure that the host-controlling thermostat is receiving the information.

In operation, the temperature up button 104 and the temperature down button 106 preferably provide for entering the menu mode, wherein user selectable parameters may be set using these buttons. Additionally, these buttons preferably provide for raising or lowering the offset temperature of the sensor 100, respectively. This offset will be indicated on the comfort adjust bar graph at 112.

Upon initial power up of the sensor 100 (i.e., on first use or after the batteries have are replaced), all LCD segments will display for a predetermined period, for example, 2 seconds, before the sensor begins normal operation. This ensures that all LCD segments are functioning properly. However, on first use, the sensor 100 will not transmit until programmed in the learn mode. If initial power up is due to the changing of batteries, the sensor 100 will transmit if the learn mode was previously initiated.

Figure 5:
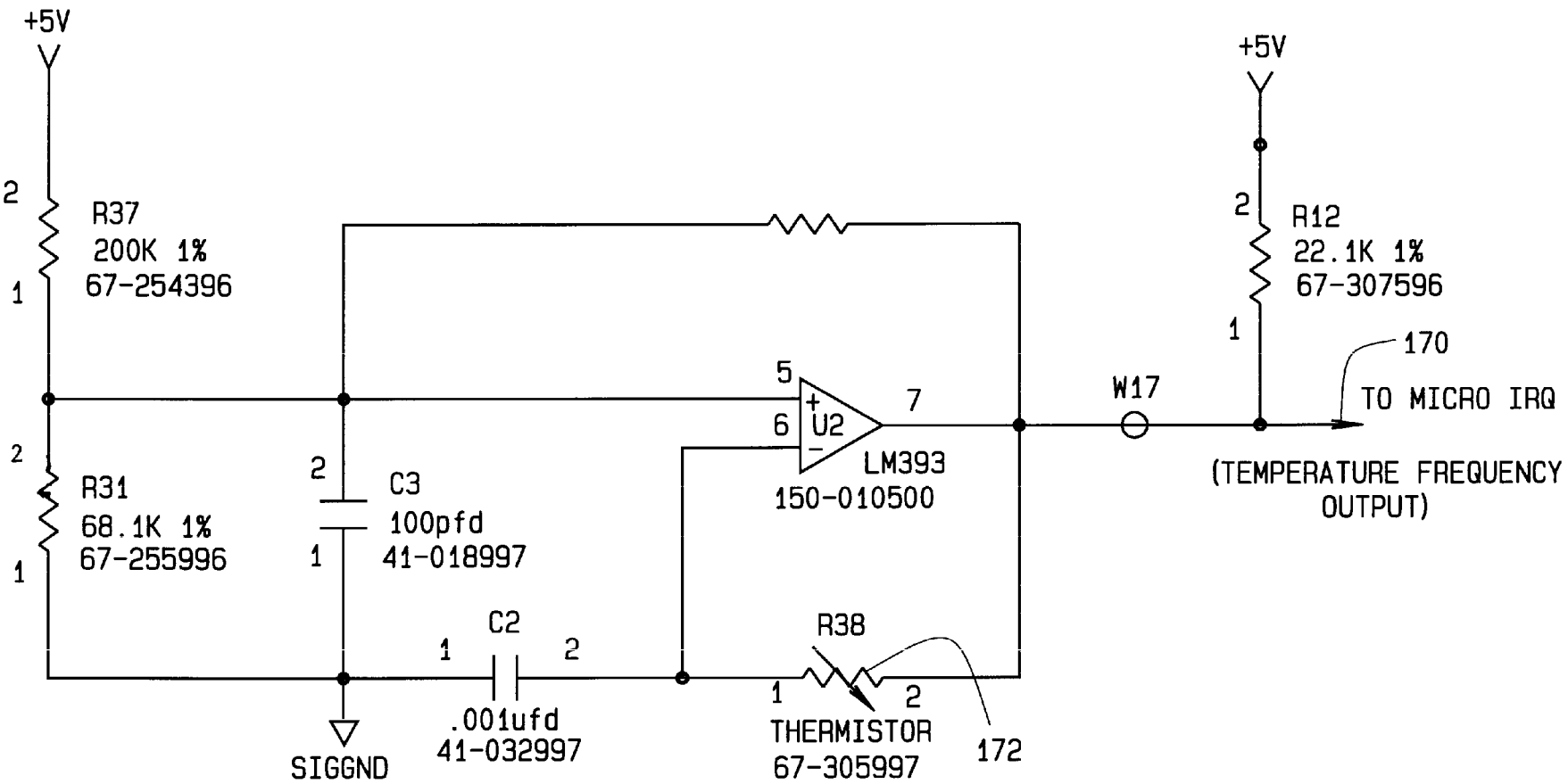
FIG. 5 is a schematic diagram of a temperature sensing circuit of the remote sensor of FIG. 1.
Figure 6:
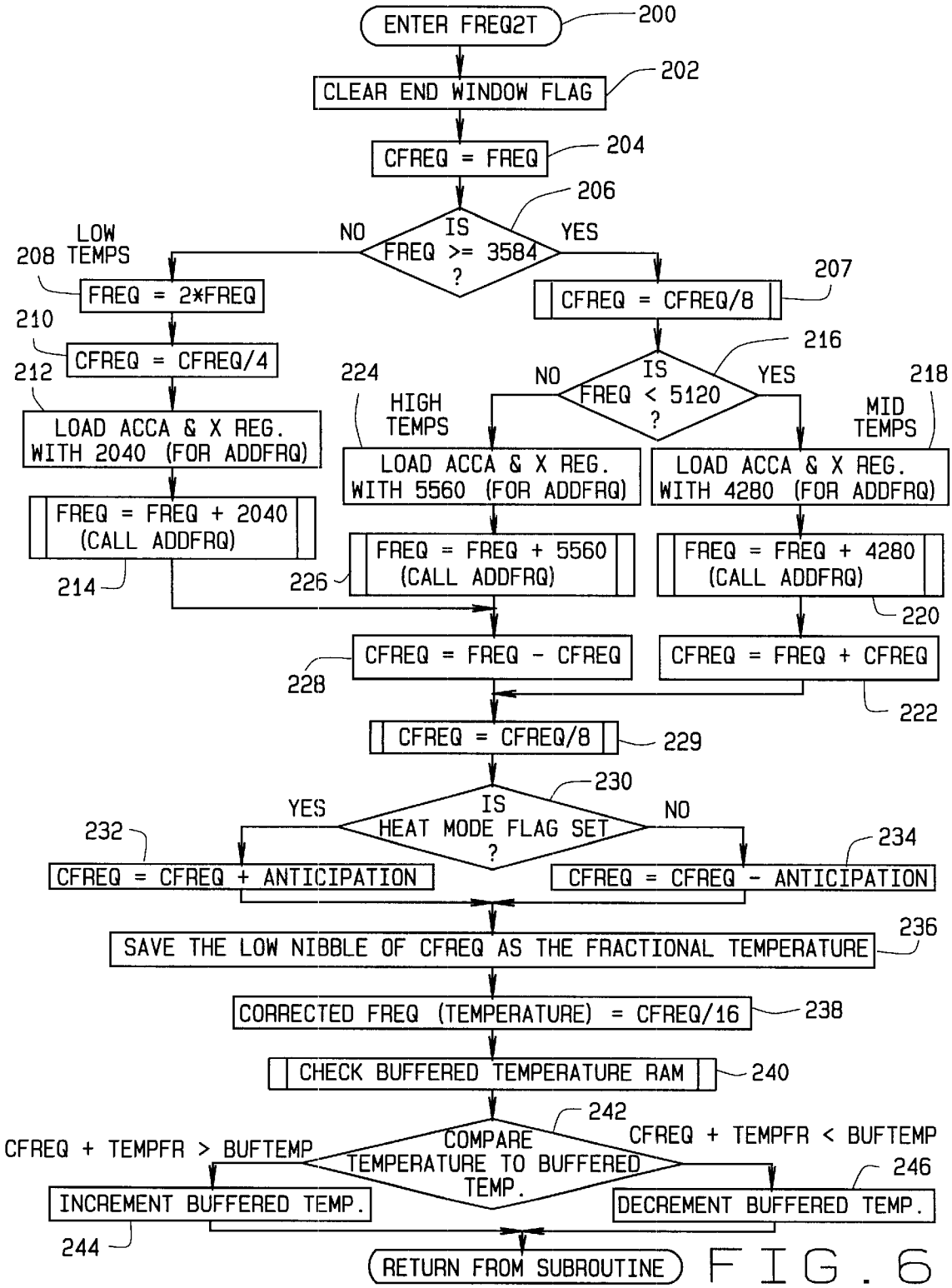
FIG. 6 is a flow chart of the conversion of the frequency output of the circuit of FIG. 5 to a temperature reading.

With respect to the sensing of temperature by the sensor 100, a temperature sensing oscillator circuit as shown in FIG. 5 is preferably provided. This circuit uses a thermistor 172 in connection with an RC circuit providing analog to digital conversion, which signal is provided to an oscillator that outputs a frequency at 170 representing the sensed temperature ("the temperature frequency output"). Thus, for example, when the temperature increases, the thermistor resistance decreases, and the temperature frequency output at 170 increases. As described below, this temperature frequency output is used in determining when to again sense temperature, as well as the transmission frequencies for future transmissions of the sensor 100. The preferred procedure for converting the frequency output of the temperature sensing oscillator circuit to a temperature reading is shown in FIG. 6. It should be noted that the conversion of the frequency output may be performed at the thermostat 160.

Specifically, and as shown in FIG. 6, the preferred procedure for converting the frequency output of the temperature sensing oscillator circuit to a temperature reading essentially determines a calculated temperature value (CFREQ) from the measured temperature frequency value (i.e., converts measured temperature frequency value to a corresponding temperature value). The calculated temperature value is compared to the displayed (i.e., buffered) temperature of the thermostat 160, which is adjusted accordingly. For example, a display of the thermostat 160 is updated based upon a measured temperature change (e.g., a 2/16° F. change). However, the display may only be updated upon a cumulative temperature change of 1° F.

In particular, a measured temperature frequency value transmitted from the sensor 100 is stored by the thermostat 160 and a sub-routine for converting the measured temperature frequency value to a calculated temperature value (i.e., frequency-to-temperature (FREQ2T) conversion) is initiated at step 200. At step 202 a temperature measurement window (e.g., six second window) is cleared for use in subsequent measurement sub-routines. At step 204 CFREQ is set to the measured temperature frequency value (FREQ). At step 206 a determination is made as to whether the measured temperature frequency value is in a low range (i.e., <3584) or a higher range (i.e., >3584) in order to determine a particular conversion equation to use. It should be noted that there are different linear conversion equations between different ranges.

If the measured temperature frequency value is in the low range, then at steps 208, 210, 212 and 214, the stored measured temperature frequency value is adjusted using a predetermined slope coefficient and offset constant (i.e., 2040). Specifically, at step 208 the FREQ value is set to twice the prior FREQ value (i.e., multiplied by two). At step 210, the CFREQ value is set to ¼ the initial CFREQ value (i.e., divide by 4). At step 212, an Accumulator (ACCA), which is a register used for mathematical operations, and a mathematical register (X REG) are loaded with the value 2040 for a subsequent addition operation (i.e., ADDFRQ sub-routine). Then, at step 214, the FREQ value is set to the prior FREQ value plus 2040 (i.e., ADDFRQ operation performed). Thereafter, at step 228, the CFREQ value is set to ⅛ the initial CFREQ value. Essentially, an adjustment value is applied to the measured temperature frequency value to compensate for changes in the slope of the temperature versus frequency curve at these different levels (i.e., curve is non-linear). These values may be adjusted, for example, if the transmitting frequency range is changed.

If the measured temperature frequency value is in the higher range, then a determination is made at step 216 as to whether the measured temperature frequency value is in a medium or high range (i.e., <5120). This determination is based upon a factional value (i.e., ⅛) of the measured temperature frequency value, which is calculated at step 207 (i.e., CFREQ value set to ⅛ initial CFREQ value) before making the medium or high range determination at step 216. Essentially, a determination is made as to the linear equation to use to convert the frequency value. If the measured temperature frequency value is determined to be in the medium range, then at steps 218 and 220 an adjustment to the stored measured temperature frequency value is again provided using a different slope coefficient and offset constant (i.e., 4280). The ACCA and X REG are again used for providing the ADDFRQ operation. If the measured temperature frequency value is in the high range, then at steps 224 and 226 an adjustment to the stored measured temperature frequency value is again provided using a different slope coefficient and offset constant (i.e., 5560). The ACCA and X REG are again used for providing the ADDFRQ operation.

An adjusted measured temperature frequency value (i.e., calculated temperature value) is then calculated and stored as CFREQ at step 222 for the medium range and at step 228 for the high or low range. For the low or high frequency range the CFREQ value is subtracted from the FREQ value to provide a new calculated CFREQ value (i.e., CFREQ=FREQ−CFREQ) and for the medium range, the CFREQ value is added to the FREQ value to provide a new calculated CFREQ value (i.e., CFREQ=FREQ+CFREQ). Thus, CFREQ is set to (7/4)*FREQ+2040 for the low range, CFREQ is set to (7/8)*FREQ+5560 for the high range and CFREQ is set to (9/8)*FREQ+4280 for the medium range. Thereafter, at step 229, these equations are divided by 8 (i.e., CFREQ/8), making the equations (7/32)*FREQ+255, (9/64)*FREQ+535 and (7/64)*FREQ+645, respectively. It should be noted that mathematical operations involving factors of two may be performed using binary shifts.

At step 230 a determination is made as to whether the thermostat 160 is in a heat or cool mode of operation in order to increment or decrement the adjusted measured temperature frequency value by an anticipation offset. In operation, the anticipation offset allows for shut-off of heating or cooling as the room temperature approaches the desired set-point temperature of the thermostat 160, but before reaching that temperature. If in a heat mode, an anticipation factor (e.g., 16) is added to CFREQ at step 232. If in a cool mode, an anticipation factor (e.g., 16) is subtracted from CFREQ at step 234. At step 236, the four least significant bits of the factional temperature value are saved because at step 238 these bits will be eliminated by dividing the conversion equations by 16. By dividing the equations by 16 at step 238, an integer number results. Thus, the equations finally become $(7/512)$*FREQ+$255/16$+/−Anticipation/16, $(9/1024)$*FREQ+$535/16$+/−Anticipation/16, and $(7/1024)$*FREQ+$645/16$+/−Anticipation/16, respectively.

Thereafter at step 240, the buffered value of the temperature stored by the thermostat 160 is checked. That is, the displayed (i.e., buffered) temperature value of the thermostat 160 is read at step 240. At step 242 a determination is made as to whether the CFREQ value is greater or less than the displayed temperature value of the thermostat 160 in order to increment or decrement the displayed (i.e., buffered) temperature value of the thermostat 160 by $1/16°$ F. at steps 244 and 246, respectively. Specifically, at step 244, if the CFREQ value+the fractional temperature determined as the low nibble at step 236 is greater than the buffered temperature, the buffered temperature is incremented by $1/16$ of a degree. At step 246 if the CFREQ value+the fractional temperature determined as the low nibble at step 236 is less than the buffered temperature, the buffered temperature is decremented $1/16$ of a degree. The sub-routine thereafter terminates having calculated a corrected measured temperature value.

Thus, for example, in operation, assuming the anticipation=16, a frequency of 3296 will equal 62 degrees, a frequency of 4160 will equal 71 degrees, and a frequency of 6080 will equal 86 degrees. These particular frequency values result in an exact integer value using the FREQ2T sub-routine described above. (i.e., the 4 bit value for addition of a fractional component would not have been saved). However, it should be noted that other frequency values may yield an integer and a fractional value of the associated temperature.

In the most preferred embodiment, indoor temperature is sensed by the sensor 100 at a rate of fifty seconds plus the three least significant bits in seconds of the temperature frequency output at 170 of the temperature from the last reading of the temperature sensing oscillator circuit. Outdoor temperature is sensed at a rate of ten minutes plus the four least significant bits in seconds of the temperature frequency output of the temperature from the last reading of the temperature sensing oscillator circuit. Essentially, this variable sensing of temperature using the least significant digits from the output of the temperature sensing oscillator circuit provides further randomization.

During the time that the temperature is actually sensed, a temperature sensing symbol at 120 is provided on the LCD display 102 to show such activity. Further, with respect to transmission rate, indoor temperature transmission is preferably provided only if a new sensed temperature including any offset is different from the last transmitted temperature reading by a pre-defined amount, for example more than $2/16°$ F. or $1/16°$ C.

With respect to the transmission of temperature information, such transmission is preferably frequency shifted by multiplying a variable number (based upon the four least significant bits of the temperature frequency output) by a specified frequency as described below, for example 230 Hz, and adding it to a center frequency of, for example 433.92 MHz. Because transmissions occur only at variable (e.g., ransom) times and only upon a temperature change, a transmission symbol at 122 is preferably provided on the LCD display 102 during each actual transmission of data.

Specifically, with respect to transmission of temperature information, the transmitter provided within the sensor is preferably configured to transmit frequency shift keying (FSK) modulation. The transmission of binary ones and zeros is provided such that a one will be represented by a bit time that is high for the first half of the bit and low for the last half of the bit and a zero shall be the opposite thereof. Additionally, a fully programmable direct digital synthesizer (DDS) is preferably provided and allows for the alteration of the transmission frequency to minimize interference. In the most preferred embodiment, the transmission frequency is determined as follows: first, the temperature is measured by determining the temperature frequency output of the temperature oscillator, the four least significant binary bits of the measured frequency (i.e., temperature frequency output) defining a "seed" number providing a set of variable numbers, which may be randomly selected, and are used as multipliers for offsets for future transmission frequencies. This offset value is added to the base frequency of the transmitter, which may be for example 433.92 MHz. Thus, if the last four binary digits of the temperature frequency are 0101, then the "seed" number 5. This "seed" number then defines a variable number sequence, which may be random, for use as the frequency multiplier for subsequent transmissions of temperature information and is transmitted to the host-controlling thermostat, such that the host-controlling thermostat is able to determine, based on the "seed", the frequencies at which the sensor 100 will subsequently transmit (e.g. the next twenty or thirty transmission frequencies). The "seed" number is used to determined the frequency offset for a predetermined period of time (e.g., eight hours), after which time a new "seed" number is determined from the temperature frequency output.

So, for example, if the "seed" number is five, this defines a random set of numbers, for example: 7, 2, 3, 9, 6, 4, 5, 3, 8, 2, 1, 9, 5, and 8. Therefore, if the frequency offset is 230 Hz, then the first transmission will occur at 433.92 MHz plus seven times 230 Hz, which is equal to 1610 Hz, or 0.001610 MHz. Thus, transmission will occur at 433.921610 MHz. The next transmission will occur at the base frequency of 433.92 MHz plus two times 230 Hz. If transmission occurs at the last number in the random number set as defined by the "seed" number before a new "seed" number is selected, the first number is used again and the sequence starts over. Alternately, if the last number defined by the "seed" is used to offset the transmission frequency, a new "seed" may be selected based on the temperature frequency output of the last transmission.

During each transmission, the sensor 100 preferably transmits the following: a leader (8 bits), device type ID (8 bits), unique ID (16 bits), channel number (8 bits), temperature data (e.g., the temperature frequency output) (16 bits), low battery bit, temperature offset, H/C indication (8 bits), learn bit (only in learn mode) (8 bits) and checksum (16 bits).

With respect to the preferable receiver within the host-controlling thermostat, the receiver is compatible with the transmitter provided within the temperature sensor 100, and operates in such a manner to minimize collisions with direct digital synthesizer (DDS) circuitry. This is required because of the frequency hopping technique employed by the transmitter.

Although the remote temperature sensor 100 of the present invention has been described with respect to specific parameters (e.g., transmission requirements and settings), and with use with respect to specific features and functions of a thermostat, the invention disclosed herein may be modified and configured for operation with other types of thermostats having various other features and functions. Further, the sensor 100 may be configured with other settable functions. Additional features may also be provided, for example, displaying the current time on the LCD display 102 of the sensor 100.

There are other various changes and modifications which may be made to the particular embodiments of the invention described herein, as recognized by those skilled in the art. However, such changes and modifications to the invention may be implemented without departing from the scope of the invention. Thus, the invention should be limited only by the scope of the claims appended hereto, and their equivalents.

What is claimed is:

1. An apparatus providing temperature information to a thermostat, the apparatus comprising:

a sensor for sensing temperature;

a storage device for storing sensed temperature data;

a comparator for comparing a current sensed temperature with a stored previously transmitted temperature; and a transmitter for transmitting the current sensed temperature together with a signal uniquely identifying the apparatus to the thermostat on a frequency selected within a fixed range, when the difference between the current sensed temperature and the stored previously transmitted temperature determined by the comparator exceeds a predetermined value.

2. The apparatus according to claim 1 wherein the transmitter transmits at a first time at a predetermined frequency within the fixed range.

3. The apparatus according to claim 2 wherein the transmitter transmits subsequent to each time after the first time at a predetermined variably selected frequency within the fixed range for a predetermined period of time.

4. The apparatus according to claim 3 wherein a plurality of variably selected frequencies for the subsequent transmissions is determined in part based upon the value of the current sensed temperature, and wherein the transmitter subsequently transmits at the variably selected frequencies.

5. The apparatus according to claim 3 wherein a plurality of variably selected frequencies for the subsequent transmissions is determined in part based upon the value of the four least significant bits of the current sensed temperature, and wherein the transmitter subsequently transmits at the variably selected frequencies.

6. The apparatus according to claim 1 wherein the signal uniquely identifying the apparatus comprises a unique serial number information.

7. The apparatus according to claim 6 wherein the signal uniquely identifying the apparatus comprises channel number information.

8. The apparatus according to claim 1 wherein the transmitter transmits the current sensed temperature when the difference between the current sensed temperature and the stored previously transmitted temperature is at least 2/16 degrees Fahrenheit.

9. The apparatus according to claim 1 wherein the transmitter transmits the current sensed temperature when the difference between the current sensed temperature and the stored previously transmitted temperature is at least 1/16 degrees Celsius.

10. The apparatus according to claim 1 wherein the transmitter transmits the current sensed temperature if no sensed temperature is transmitted for at least a predetermined period of time.

11. The apparatus according to claim 1 wherein the transmitter is adapted to provide automatic recognition of the specific apparatus by the thermostat using the signal uniquely identifying the apparatus.

12. In combination with a digital thermostat, at least one temperature sensing apparatus providing temperature information to the thermostat from a remote location, the temperature sensing apparatus comprising:

a sensor for sensing temperature;

a processor connected to the sensor with a memory unit for storing sensed temperature data and a comparator for comparing a current sensed temperature with a stored previously transmitted temperature; and a transmitter for transmitting the current sensed temperature on a frequency selected within a fixed range, when the difference between the current sensed temperature and the stored previously transmitted temperature determined by the comparator exceeds a predetermined value.

13. The combination according to claim 12 wherein the transmitter transmits a signal uniquely identifying the apparatus to the thermostat with the current sensed temperature.

14. The combination according to claim 12 wherein a variable time period for sensing temperature is determined in part by a value based upon a previously sensed temperature, and wherein the sensor senses temperature at the variable time period.

15. The combination according to claim 12 wherein a variable time period for sensing temperature is determined in part by a value based upon the three least significant bits of a previously sensed temperature, and wherein the sensor senses temperature at the variable time period.

16. The combination according to claim 12 wherein the selected frequency is variable and determined in part by a value based upon the current sensed temperature, and wherein the sensor transmits the current sensed temperature at the selected frequency.

17. The combination according to claim 12 wherein the selected frequency is variable and determined in part by a value based upon the four least significant bits of the current sensed temperature, and wherein the sensor transmits the current sensed temperature at the selected frequency.

18. The combination according to claim 12 wherein the digital thermostat is adapted to receive transmissions and wherein the transmission of each sensor is given a weight by the thermostat.

19. The combination according to claim 12 wherein the transmitter is adapted for transmission at one of a plurality of power levels.

20. The combination according to claim 13 wherein the transmitter is adapted to automatically transmit during a learn mode the signal uniquely identifying the sensor to the thermostat for later identification of a sensed temperature transmission from the sensor.

21. The combination according to claim 12 wherein the sensor further comprises a display providing sensor information.

22. The combination according to claim 21 wherein the display provides sensed temperature information.

23. A method of providing temperature information to a thermostat from a remote location, the method comprising the steps of:

sensing a temperature, storing sensed temperature data, comparing a current sensed temperature with a stored previously transmitted temperature, and transmitting the current sensed temperature on a frequency selected within a fixed range, when the difference between the current sensed temperature and the stored previously transmitted temperature exceeds a predetermined value.

24. The method according to claim 23 wherein the step of transmitting further comprises transmitting a signal uniquely identifying the transmission with the current sensed temperature.

25. The method according to claim 23 further comprising selecting a specific frequency within the fixed range for transmitting the current sensed temperature.

26. The method according to claim 25 wherein the step of selecting a specific frequency further comprises selecting for each transmission a predetermined frequency that is variable within the fixed range, and wherein the step of transmitting the current sensed temperature further comprises transmitting at the selected frequency.

27. The method according to claim 26 wherein the step of selecting a predetermined frequency further comprises determining the selected frequency based in part upon the value of the current sensed temperature, and wherein the step of transmitting the current sensed temperature further comprises transmitting at the selected frequency.

28. The method according to claim 26 wherein the step of selecting a predetermined frequency further comprises determining the selected frequency based in part upon the value of the four least significant bits of the current sensed temperature, and wherein the step of transmitting the current sensed temperature further comprises transmitting at the selected frequency.

29. The method according to claim 23 wherein the step of transmitting the current sensed temperature further comprises transmitting the current sensed temperature only when the difference between the current sensed temperature and the stored previously transmitted temperature is at least 2/16 degrees Fahrenheit.

30. The method according to claim 23 wherein the step of transmitting the current sensed temperature further comprises transmitting the current sensed temperature only when the difference between the current sensed temperature and the stored previously transmitted temperature is at least 1/16 degrees Celsius.

31. The method according to claim 23 wherein the step of transmitting the current sensed temperature further comprises transmitting the current sensed temperature if no current sensed temperature is transmitted for at least a predetermined period of time.

32. The method according to claim 24 wherein the step of transmitting the current sensed temperature further comprises transmitting a unique serial number identifying the transmission.

33. The method according to claim 24 wherein the step of transmitting the current sensed temperature further comprises transmitting a channel number.

34. The method according to claim 23 wherein the step of sensing a temperature further comprises sensing the temperature at a variable time period determined in part on a value based upon a previously sensed temperature.

35. The method according to claim 23 wherein the step of sensing a temperature further comprises sensing the temperature at a variable time period determined in part on a value based upon the three least significant bits of a previously sensed temperature.

36. In combination with a digital thermostat, at least one programmable remote temperature sensor providing temperature information to the thermostat, the temperature sensor comprising:

a temperature sensing member for sensing temperature at a specified time period;

a storage member for storing sensed temperature data;

a comparator for comparing a current sensed temperature with a stored previously transmitted temperature;

a transmitter for transmitting the current sensed temperature together with a signal uniquely identifying the sensor to the digital thermostat on a frequency selected within a fixed range, when the difference between the current sensed temperature and the stored previously transmitted temperature determined by the comparator exceeds a predetermined value; and a comfort adjust member for setting an offset to be transmitted with the current sensed temperature.

37. The combination according to claim 36 wherein the digital thermostat is adapted to receive transmissions and the transmission of the current sensed temperature by each remote temperature sensor is provided with a weight by the thermostat.

38. The combination according to claim 36 wherein the transmitter is adapted for transmission at one of a plurality of power levels.

39. The combination according to claim 36 wherein the transmitter is adapted to automatically transmit during a learn mode the signal uniquely identifying the sensor to the thermostat for later identification of a sensed temperature transmission from the sensor.

40. The combination according to claim 36 wherein the specified time period is determined in part by the value of the previously sensed temperature, and wherein the temperature sensing member is adapted to sense temperature at the specified time period.

41. The combination according to claim 36 wherein the specified time period is determined in part by the value of the three least significant bits of the previously sensed temperature, and wherein the temperature sensing member is adapted to sense temperature at the specified time period.

42. The combination according to claim 36 wherein the sensor further comprises a display providing sensor information.

43. The combination according to claim 42 wherein the display is adapted to indicate the offset provided by the comfort adjust member.

44. The combination according to claim 36 wherein the transmitter is adapted to transmit a channel number and a unique serial number identifying the transmission, together comprising the signal uniquely identifying the sensor to the thermostat.

45. The combination according to claim 36 wherein the display is adapted to indicate the channel number of the temperature sensor.

46. The combination according to claim 36 wherein the selected frequency is determined in part by the value of the current sensed temperature, and wherein the sensor transmits the current sensed temperature at the selected frequency.

47. The combination according to claim 36 wherein the selected frequency is determined in part by the value of the four least significant bits of the current sensed temperature, and wherein the sensor transmits the current sensed temperature at the selected frequency.

* * * * *